United States Patent [19]

Delaney et al.

[11] Patent Number: 4,619,746

[45] Date of Patent: Oct. 28, 1986

[54] PROCESS FOR TOPCOATING AN ELECTROCOATED SUBSTRATE WITH A HIGH SOLIDS FLUID COATING

[75] Inventors: James M. Delaney, Blawnox; Edward L. Jozwiak, Gibsonia, both of Pa.

[73] Assignee: PPG Industries, Inc., Pittsburgh, Pa.

[21] Appl. No.: 782,826

[22] Filed: Oct. 2, 1985

[51] Int. Cl.[4] ..... C25D 13/06; C25D 13/04

[52] U.S. Cl. ..... 204/181.1; 204/181.4; 204/181.7; 428/413; 428/414; 428/416; 428/418; 428/422.8

[58] Field of Search ..... 204/181.1, 181.4, 181.7; 428/413, 414, 416, 418, 422.8

[56] References Cited

U.S. PATENT DOCUMENTS

| | | | |
|---|---|---|---|
| 3,498,897 | 3/1970 | Bogart et al. | 204/181.1 |
| 3,674,670 | 7/1972 | Erikson et al. | 204/181.1 |
| 3,702,813 | 11/1972 | Tanaka et al. | 204/181.1 |
| 4,066,591 | 1/1978 | Scriven et al. | 204/181.4 |
| 4,137,140 | 1/1979 | Belanger | 204/181.7 |
| 4,375,498 | 3/1983 | Leminez et al. | 204/181.1 |
| 4,420,574 | 12/1983 | Moriarity | 204/181.7 |
| 4,456,507 | 6/1984 | Kivel et al. | 204/181.1 |
| 4,475,524 | 3/1986 | Anderson et al. | 204/181.7 |
| 4,477,642 | 10/1984 | Geist et al. | 204/181.1 |
| 4,512,862 | 4/1985 | Doroszkowski | 204/181.4 |

FOREIGN PATENT DOCUMENTS

| | | | |
|---|---|---|---|
| 52-65534 | 5/1977 | Japan | 204/181.1 |

*Primary Examiner*—Arthur P. Demers

*Attorney, Agent, or Firm*—Godfried R. Akorli

[57] ABSTRACT

A process for applying a non-electrophoretic top-coating over an electrophoretically applied base coating and curing the composite coating by employing a single curing step is disclosed.

13 Claims, No Drawings

PROCESS FOR TOPCOATING AN ELECTROCOATED SUBSTRATE WITH A HIGH SOLIDS FLUID COATING

FIELD OF THE INVENTION

The invention relates to a process for preparing a multilayered coated article in which the coatings are applied via a wet-on-wet mode followed by curing the multilayered coating in one step. More specifically, the present invention relates to a process for preparing a multilayered coated article wherein the topcoat is a high solids fluid composition.

BACKGROUND OF THE INVENTION

Metal surfaces can be protected and given an aesthetic appearance by the application of one or more coats of paint. Typically, two or more coats are usually applied. They may comprise (1) a primer or basecoat to provide corrosion protection;

(2) a topcoat to provide an aesthetic appearance.

The topcoating can be applied in a wet-on-wet mode, i.e., without first curing the basecoat, and with a minimum of flash time for the basecoat, before the topcoat is applied to the basecoat.

It has been found that the wet-on-wet mode of applying high solids fluid thermosetting topcoats leaves something to be desired as to the visual appearance and durability of the coated substrate. This is due seemingly to intermixing of the basecoat and topcoat and bubbling of the primer through the topcoat. This results in the creation of large surface crawling or cratering in the topcoat. To avoid the intermixing of the basecoat and topcoat, presumably less mixable coatings such as powder coatings have been employed as topcoatings. The present invention provides an improved wet-on-wet mode of coating which produces improved durability and appearance of the coated substrate.

SUMMARY OF THE INVENTION

In accordance with the foregoing, the present invention encompasses a method of applying a decorative or protective coating to a substrate, comprising:

(i) electrophoretically applying a basecoat on the substrate, (ii) drying the substrate by baking the same over an effective temperature-time schedule to a stage short of complete cure so as to evaporate residual water and volatile material from the coating in order to effect reflow of said coating, (iii) non-electrophoretically applying a thermosetting fluid, high solids topcoat comprising isocyanate curing agents, (iv) curing the substrate by baking the same over a temperature-time schedule sufficient to effect complete cure.

The process of this invention results in a finish having an improved visual appearance. Additionally, the multilayered coating exhibits an improved film durability.

In the context of this invention, it should be understood that the given temperature-time schedules of drying or curing can be changed to different but equivalent schedules. Illustratively, a coating can be baked at relatively higher temperatures over a shorter period of time in order to achieve essentially the same effect as in a coating baked at relatively lower temperature over a longer period of time. At any rate, the terms "drying" and "curing" refer to different kinds of temperature-time schedules.

The basecoat usually contains a binder comprising an active hydrogen-containing material, a crosslinking agent and additives as described more fully hereinbelow. The active hydrogen-containing material can be a hydroxyl-functional, an amine-functional, or mercapto-functional or a mixture thereof. Illustrative examples of the binders can be resinous polyols, polyamines, epoxy resins, polyurethanes and the like. The crosslinking agents for the basecoats are preferably isocyanates, including blocked isocyanates. Other useful crosslinking agents can be aminoplasts or phenoplasts or the like. The additives comprise pigments, coalescing agents and the like.

Typically, the basecoat is a primer. In accordance with this invention, the primer is electrophoretically applied as described hereinbelow. Aqueous dispersions of the basecoat are employed for use as electrodepositable compositions. The aqueous dispersion is placed in contact with an electrically conductive anode and an electrically conductive cathode. The surface to be coated can be made the cathode or the anode. In the case of cationic electrodeposition, which is preferred herein, the surface to be coated is the cathode. Following contact with the aqueous dispersion, an adherent film of the coating composition is deposited on the electrode being coated when a sufficient voltage is impressed between the electrodes. Conditions under which electrodeposition is carried out are known in the art. The applied voltage may be varied and can be, for example, as low as one volt or as high as several thousand volts, but is typically between 50 and 500 volts. Current density is usually between 1.0 ampere and 15 amperes per square foot and tends to decrease during electrodeposition indicating the formation of an insulating film.

Specific examples of the electrodepositable compositions and methods of making and using the same are disclosed in the following patents which are incorporated herein by reference. U.S. Pat. No. 4,420,574 discloses electrodepositable compositions comprising cationic resins formed from reacting polyepoxides, with polyoxyalkylene amines, followed by neutralizing the resultant product, at least partially, to provide cationic groups. U.S. Pat. No. 4,468,307 discloses cationic resins derived from polyepoxides reacted with polyether polyols wherein the resultant resin is reacted with a cationic base group such as an amine group; mixtures of the above resin are also useful herein.

After the electrodeposition, the substrate is dried preferably by baking over an effective temperature-time schedule to a stage short of complete cure so as to evaporate residual water and volatile material such as solvents from the coating and in order to effect reflow of the coating. Typically, the coated substrate is dried at about 300° to 350° F. (149° to 177° C.) for about 4 to 10 minutes and typically about 5 minutes. The dried electrodeposited composition is then topcoated in accordance with this invention. As would be realized, therefore, the process of coating referred to herein as a wet-on-wet mode can be aptly described as a wet-on-dry mode.

An important feature of the invention is the thermosetting fluid high solids topcoats comprising isocyanate curing agents. Ordinarily, high solids topcoats which are applied in a wet-on-wet mode exhibit less than desirable visual appearance. By the process of this invention, an improved visual appearance is obtained. Additionally, there is obtained good durability and other desirable film properties.

The topcoating comprises low molecular weight active hydrogencontaining materials such as described hereinabove. The weight molecular weight is typically up to about 1500 and preferably up to about 1000 based on polystyrenes standards. Non-limiting examples of the low molecular weight active hydrogen-containing materials are modified drying oils, alkyds, polyesters, polyurethanes, acrylic polymers, epoxy polymers, polyamines, a mixture thereof and the like.

Blocked polyisocyanates are typically used as the curing agents of the topcoating composition. The preferred blocked polyisocyanates are polyisocyanates such as triisocyanates that are blocked with caprolactam. The blocked isocyanate is employed in a ratio of 0.8 to 1.2:1 based on isocyanate to hydroxyl equivalents.

Cure catalysts such as tin octoate, dibutyltin dilaurate and the like are usually employed. Other additives such as coalescing agents, flow control agents and the like can be employed. The topcoating can be clear or pigmented. In the latter case, pigments such as carbon black or titanium dioxide and the like can be used.

The topcoating composition is applied by non-electrophoretic means, typically by spraying. Other means of application can be employed, as well. After topcoating, the multilayered coating is baked over a temperature-time schedule sufficient to provide effective cure. For example, the multilayered coating can be baked at 150° to 220° C. for about 20–30 minutes in order to effect cure. The resultant baked coating has an improved visual appearance and durability.

The following non-limiting examples further illustrate the invention.

EXAMPLE I

By the method of this invention panels of cold rolled steel substrates were electrocoated, dried and topcoated with high solids topcoatings followed by baking the composite coatings.

The following were used in formulating the high solids topcoatings.

| Ingredients | Parts by Weight | Non-Volatiles |
|---|---|---|
| Melaminate grind resin[1] | 28.1 | 22.5 |
| CASPOL 1852[2] | 77.8 | 70 |
| Titanium dioxide | 375.0 | 375 |
| Xylene | 41.6 | |
| CASPOL 1852 | 55.6 | 50 |
| SOLVESSO 100 | 22.4 | |
| CASPOL 1852 | 55.9 | 50 |
| Blocked isocyanate[3] | 256.2 | 159 |
| Tin catalyst | 3.8 | 3.8 |
| L-7500 silicone | 1.1 | 0.1 |
| Microgel[4] | 42.6 | 18.8 |
| SOLVESSO 100[5] | 40.0 | |

[1]Prepared by reacting CYMEL 300 available from American Cyanamid Company, 1-6, hexanediol, dimethylol propionic acid and hydroxyethyl ethyleneimine.
[2]Resinous polyol having a hydroxyl equivalent weight of 407.2 and hydroxyl number of 137.8, available from Cas Chemical Inc.
[3]Prepared by reacting 1 mole of trimethylolpropane, 3 moles of isophorone diisocyanate and 3 moles of caprolactam.
[4]Compatible acrylic polymer used herein as sag control agent.
[5]An aromatic solvent.

A topcoating composition was prepared with the above ingredients in essentially the same manner as described in Example I. The resultant coating had a pigment-to-binder ratio of 1:1, a non-volatile content of 75 percent and a volatile organic content of 3.0. As described hereinbelow, the topcoating composition was applied to an electrocoated substrate in accordance with this invention.

The electrocoating was conducted at a bath temperature of 28°–30° C., conductivity of 1200–1600 microhms at a voltage of 150–225 volts for 90–120 seconds.

A basecoat was applied to a cold rolled steel substrate by electrocoating the substrate in a bath containing a cationic electrodepositable composition available from PPG Industries, Inc. under the trademark UNI-PRIME. The electrocoated substrate was removed from the electrocoat bath, rinsed with water and baked at 350° F. (177° C.) for 5 minutes.

The above topcoating composition was spray applied to a thickness of 1.5 mils on the electrocoated and dried substrate which was then baked to cure at 350° F. (177° C.) for 20 minutes. The coated and cured substrate had a pencil hardness of HB, 60° gloss of 80 percent, and it took 100 or more acetone double rubs to remove the coating.

EXAMPLE II

This example further illustrates the invention by employing a high solids topcoating comprising polyamine resins. The topcoating was formulated with the following:

| Ingredients | Parts by Weight | Non-Volatiles |
|---|---|---|
| JEFFAMINE T-403[1] | 60.0 | 60 |
| Melaminate grind vehicle[2] | 29.8 | 23.8 |
| Titanium dioxide (pigment) | 340 | 340 |
| Xylene | 11.3 | |
| JEFFAMINE T-403 | 16.2 | 16.2 |
| Blocked isocyanate[3] | 360.2 | 216 |
| L-7500 silicone | 1.0 | 0.1 |
| Tin catalyst | 3.4 | 3.4 |
| Microgel[4] | 46.4 | 20.4 |
| SOLVESSO 100 | 22.7 | |
| Butanol | 3.8 | |

[1]Polyamine resin available from Texaco Co.
[2]Same as in Example I.
[3]Same as in Example I.
[4]Same as in Example I.

The resultant coating had a pigment-to-binder ratio of 1:1, volatile organic content of 2.9, and a non-volatile content of 76 percent.

The coating composition was used in topcoating a substrate which was electrocoated with UNI-PRIME. The electrocoating is as conducted under essentially the same conditions as described in Example I. The electrocoated substrate was removed from the electrocoating bath, rinsed with water and then dried by baking the same at 350° F. (177° C.) for 5 minutes.

Thereafter, the above topcoating was spray-applied to a thickness of 1.5 mils on the dried electrocoat. The coated substrate with the composite basecoat and topcoat was baked to cure at 350° F. (177° C.) for 20 minutes. The coated substrate had a pencil hardness of 2H, 60° gloss of 62 percent, and it took 100 or more acetone double rubs to remove the coating.

Therefore, what is claimed is:

1. A method of applying a decorative or protective coating to a substrate, comprising:

(i) electrophoretically applying a basecoat on the substrate, (ii) drying the substrate by baking over an effective temperature-time schedule to a stage short of complete cure so as to evaporate residual water and volatile material from the coating in order to effect reflow of said coating, (iii) non-electrophoretically applying a thermosetting fluid, high solids topcoat comprising isocyanate curing agents, (iv) curing the substrate by baking the same over a temperature-time schedule sufficient to effect complete cure.

2. A method of claim 1, wherein the high solids coating comprises a low molecular weight active hydrogen-containing polymer.

3. A method of claim 1, wherein the primer coating is derived from a cationic electrodepositable composition comprising an aqueous dispersion of an active hydrogen-containing material and a cationic base group.

4. A method of claim 3, wherein the cationic base group is an amine salt or onium salt.

5. A method of claim 1, wherein drying of the substrate is at 250°–300° F. for about 5 minutes.

6. A method of claim 1, wherein the non-electrophoretic application of the top-coating is by spraying.

7. A method of claim 6, wherein the top-coating comprises a mixture of:

(a) a low molecular weight active hydrogen-containing polymer, having a weight average molecular weight up to 1500 and (b) a curing agent.

8. A method of claim 7, wherein the low molecular weight active hydrogen-containing polymer is a polyester polyol, a polyurethane polyol, a polyamine, or an acrylic polymer.

9. A method of claim 7, wherein the polyamine is a polyoxyalkylene polyamine.

10. A method of claim 7, wherein the curing agent is a blocked polyisocyanate.

11. A method of claim 10, wherein the polyisocyanate contains at least 3 reactive isocyanato groups.

12. A method of claim 11, wherein the polyisocyanate is blocked with caprolactam or methyl ethyl ketoxime.

13. An article of matter which is prepared by the process of claim 1.

* * * * *